US006705069B1

(12) United States Patent
Talley et al.

(10) Patent No.: US 6,705,069 B1
(45) Date of Patent: Mar. 16, 2004

(54) SELF-SETTING YARN

(75) Inventors: Arthur Talley, Melbourne, FL (US); Arnold E. Wilkie, Merritt Island, FL (US); Karl H. Buchanan, Arden, NC (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/655,186

(22) Filed: Sep. 5, 2000

Related U.S. Application Data

(62) Division of application No. 09/205,733, filed on Dec. 4, 1998, now Pat. No. 6,158,204.

(60) Provisional application No. 60/067,288, filed on Dec. 5, 1997, provisional application No. 60/096,844, filed on Aug. 18, 1998, and provisional application No. 60/096,845, filed on Aug. 18, 1998.

(51) Int. Cl.[7] ..... D02G 3/02

(52) U.S. Cl. ..... 57/210; 57/206; 57/207; 57/208; 57/211; 57/227; 57/238; 57/239; 57/245

(58) Field of Search ..... 57/206, 207, 208, 57/210, 211, 227, 238, 239, 245

(56) References Cited

U.S. PATENT DOCUMENTS

| | | | | |
|---|---|---|---|---|
| 3,469,387 A | | 9/1969 | Chamberlain, Jr. et al. | 57/140 |
| 3,763,640 A | | 10/1973 | Nage et al. | 57/34 |
| 3,900,623 A | | 8/1975 | Hatt | 428/92 |
| 4,019,311 A | * | 4/1977 | Schippers | 57/245 |
| 4,026,099 A | | 5/1977 | Phillips | 57/34 B |
| 4,189,338 A | | 2/1980 | Ejima et al. | 156/167 |
| 4,217,321 A | * | 8/1980 | Campbell | 264/168 |
| 4,269,888 A | | 5/1981 | Ejima et al. | 428/296 |
| 4,802,330 A | | 2/1989 | Yugve et al. | 57/238 |
| 5,162,074 A | | 11/1992 | Hills | 156/644 |
| 5,344,710 A | | 9/1994 | Jacob et al. | 428/370 |
| 5,372,885 A | | 12/1994 | Tabor et al. | 428/373 |
| 5,503,929 A | | 4/1996 | McCullough, Jr. et al. | 428/364 |
| 5,593,777 A | | 1/1997 | Jacob et al. | 428/370 |
| 5,701,644 A | | 12/1997 | Kaegi et al. | 28/220 |

FOREIGN PATENT DOCUMENTS

| | | |
|---|---|---|
| DE | 195 17 348 C | 8/1996 |
| GB | 1 382 597 A | 2/1975 |

* cited by examiner

*Primary Examiner*—John J. Calvert
*Assistant Examiner*—Shaun R Hurley
(74) *Attorney, Agent, or Firm*—Margaret S. Millikin

(57) ABSTRACT

A self-set yarn made from bicomponent fibers forms helical crimps that lock in twist and form bulk.

7 Claims, 13 Drawing Sheets

B35 / BS400

AFTER STEAMING
(9a)

BEFORE STEAMING
(9b)

PBT / PET 50 / 50 IIT

B35 / PET 50 / 50 7A

700 / 700 HEATSET IH(6.0 TPI)

21 B35 / BS400(28) DRAW

6A BS700 / BS400(0,0)

6C BS700 / BS400(0,0) DRAW

20D BS700 / N6,6(0,0) DRAW

SELF-SETTING YARN

CROSS-REFERENCE TO RELATED APPLICATIONS

This application is a divisional of application Ser. No. 09/205,733, filed Dec. 4, 1998 now U.S. Pat. No. 6,158,204.

This application claims priority of provisional applications, U.S. Provisional Application Serial No. 60/067,288, filed Dec. 5, 1997; U.S. Provisional Application Serial No. 60/096,844, filed Aug. 18, 1998; and U.S. Provisional Application Serial No. 60/096,845, filed Aug. 18, 1998.

FIELD OF THE INVENTION

This invention relates to fibers, either in staple or filament form, which exhibit permanent twist without heatsetting and to methods of making such yarn.

BACKGROUND OF THE INVENTION

Conventional plied yarns are made of either staple or filament yarns. In making a plied yarn from staple yarn, the staple yarn must be processed through carding and drafting, and then spun into a singles yarn. Two or more singles yarns are combined, typically by twisting them together, to form a plied spun yarn. In making a plied yarn from filament yarns two or more singles yarns are combined, typically by twisting them together, to form a plied yarn. The plied yarn (from filament or spun yarn) can be made directly by twisting the two singles yarns, with or without also twisting the individual singles yarn.

In either case, the plied yarns are subsequently treated with heat, called heatsetting, to set the twists permanently into the singles yarns. Heatsetting is considered an essential process in making conventional plied yarns. Without heatsetting, the plied yarns, upon being cut (such as in the manufacture of cut-pile carpet), lose ply-twist at the cut ends. The loss of ply-twist causes the singles yarns (or individual filaments if the yarn is a single ply) to separate from each other, considerably reducing wear performance. Furthermore, compressive forces, like that of foot traffic, will cause the individual filaments to flare and buckle, losing tuft resilience and giving the carpet a worn appearance.

Heatsetting is a labor, energy and capitol intensive process. Thus, heatsetting introduces expense into the manufacturing process. The heatsetting process involves unwinding the yarn to be heatset, heatsetting it and then rewinding it. Not only is it another processing step, but the generation of heat for the heatsetting step is expensive. Moreover, the equipment necessary to heatset requires capital investment. Heatsetting can also cause deleterious changes in the physical properties of yarn, such as shrinkage which may be non-uniform, luster, bulk, dyeability and other properties. It would be advantageous to eliminate the heatsetting step altogether and still obtain the benefits (e.g., locking of twist) achieved by it, without the disadvantages.

In the singles form, a conventional yarn that has been twisted, but not heatset, has torque and will form a tangled mass if tension on it is released, thus making it difficulty to process. It would be advantageous for some end uses to have a torque-free twisted singles yarn.

SUMMARY OF THE INVENTION

Accordingly, it is an object of the present invention to provide a singles yarn that will hold twist without heatsetting.

Another object of the present invention is to provide a twisted plied yarn that does not require heatsetting to maintain tuft integrity.

A further object of the present invention is to provide a process for making a twist-set cabled yarn without heatsetting.

A still further object of the present invention is to provide a carpet yarn capable of high twist levels while retaining favorable bulk.

Yet another object of the present invention is to provide a process for making a twist-set cabled yarn that obviates the draw-texturing and heatsetting steps.

Still another object of the present invention is to provide a process for making a twist-set cabled yarn that obviate the texturing and heatsetting steps.

These and related objects and advantages, as be apparent to those of ordinary skill after reading the following detailed description of the invention, are achieved in a self-set yarn comprised of at least one yarn that is comprised of a majority of multicomponent fibers having a first polymer component with a first stress relaxation response and, longitudinally co-extensive therewith, a second polymer component with a second stress relaxation response. The first polymer component and the second polymer component are arranged in a side-by-side or eccentric sheath/core fashion. The yarn is permanently twisted to at least 1 tpi, and the first stress relaxation response and the second stress relaxation response are sufficiently different to produce at least a 10% decrease in length of said yarn.

The yarn preferably has at least two plies of the multifilament yarn which are twisted together. The first polymer component and the second polymer component may both be nylon 6 polymers that differ from each other in relative viscosity.

The present invention is also a process for making self-set yarn. The process comprises the steps of (a)twisting a yarn comprised of a majority of multicomponent fibers having a first polymer component with a first stress relaxation response and, longitudinally co-extensive therewith, a second polymer component of a second stress relaxation response, wherein the first stress relaxation response and the second stress relaxation response are sufficiently different to produce at least a 10% decrease in length of the yarn and wherein the first polymer component and the second polymer component are arranged in a side-by-side or eccentric sheath/core fashion; (b) after said twisting, stressing the resulting twisted yarn; and after said stressing, allowing the twisted yarn to relax. The yarn is twisted to at least 1 tpi and preferably the twisting is ply-twisting together at least two plies of the multifilament yarn The stressing may be a thermal or mechanical stressing.

The products of this invention have self-set characteristics, which offer economic and physical advantages over conventional products by obviating the process of heatsetting and improving yarn bulk, dyeability, appearance retention and many other properties.

BRIEF DESCRIPTION OF THE DRAWINGS

FIG. 1(*a*) is a singles yarn that has been untwisted from the 2-ply heatset yarn of FIG. 1(*b*).

FIGS. 1(*c*)–(*d*) show a prior art yarn prior to heatsetting. FIG. 1(*c*) is a singles yarn that has been untwisted from the 2-ply yarn of FIG. 1(*d*).

FIG. 7(*a*) is a singles yarn that has been untwisted from the 2-ply self-set yarn of FIG. 7(*b*). FIGS. 7(*c*)–(*d*) show a self-settable yarn of the present invention prior to setting. FIG. 7(*c*) is a singles yarn that has been untwisted from the 2-ply yarn of FIG. 7(*d*).

DETAILED DESCRIPTION OF THE PREFERRED EMBODIMENTS

Figure 1:
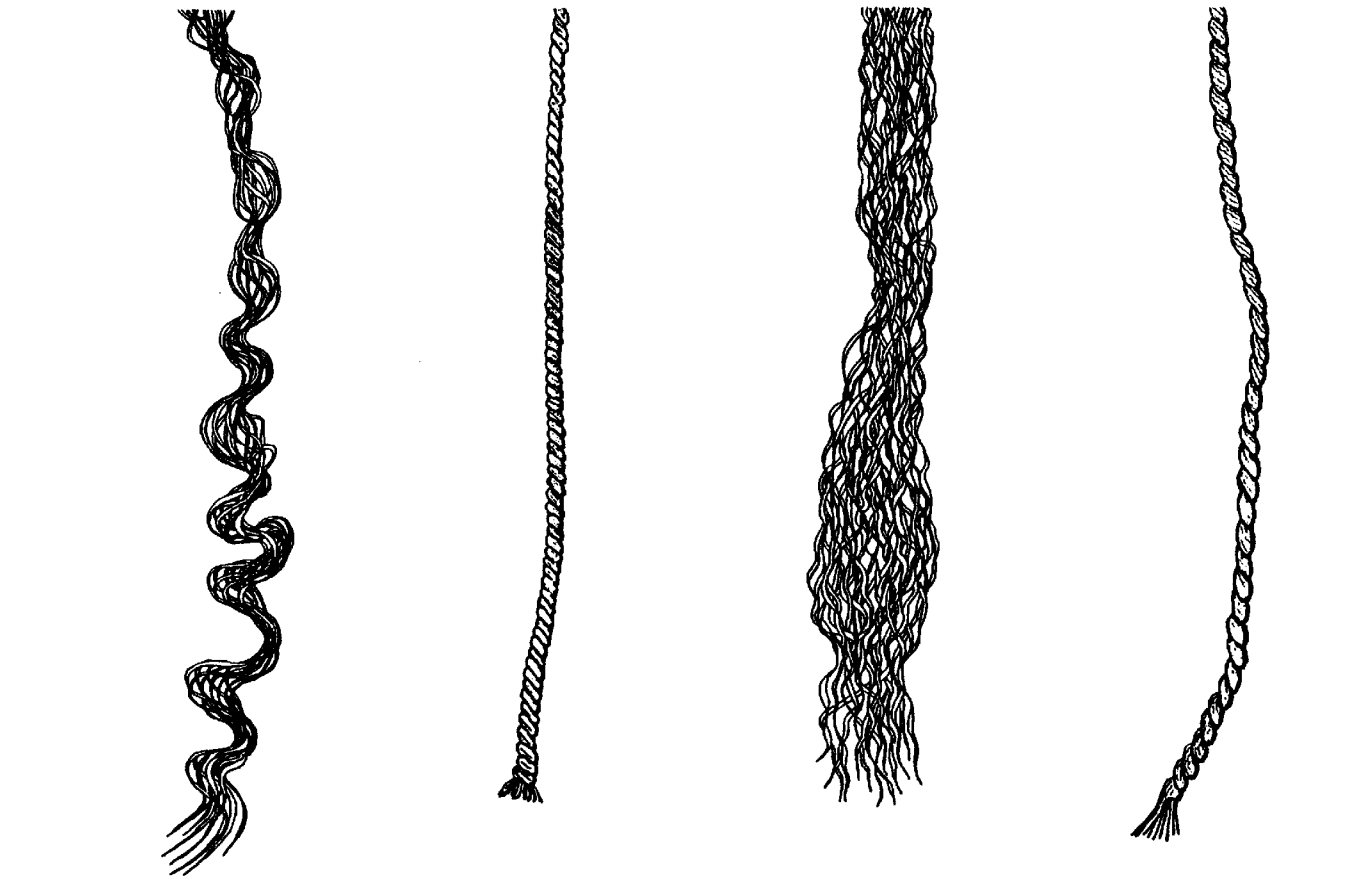
FIGURE 1 (Prior Art)
FIGS. 1(*a*)–(*b*) show a prior art heatset yarn.

To promote an understanding of the principles of the present invention, descriptions of specific embodiments of the invention follow and specific language describes the same. It will nevertheless be understood that no limitation of the scope of the invention is thereby intended and that such alteration and further modification and such further applications of the principles of the invention as discussed are contemplated as would normally occur to one ordinarily skilled in the art to which the invention pertains.

In the description of the present invention, certain terms are intended to have certain meanings consistent with the ordinary usage of the terms in the art. As used herein, "RV" denotes "relative viscosity". The term "bicomponent" refers to fiber having at least two distinct cross-sectional domains respectively formed of from two or more polymer types, which polymer types differ from each other in monomeric unit (e.g., caprolactam vs. ethylene) or in physical properties (e.g., high RV vs. low RV). It is contemplated that the different physical properties can be present as supplied. Alternatively, these properties can be created in the spinning process itself from, for example, varying the thermal history of the respective polymers. "Self-set" or "self-setting" refers to the property of, even in the absence of heatsetting, permanently holding twist and/or bulk without significant torque to substantially the same similar degree as conventional heatset yarns. "Self-settable" means capable of being self-set. A self-set yarn has a memory for the twisted or cabled condition without heatsetting such that the twist is permanently imparted to the yarn to substantially the same degree as twist is permanently imparted to conventionally heatset yarns. Thus, the term "permanent" in the context of this application refers to the relative permanency achieved with heatsetting conventional yarns. While it is theoretically possible to remove the heatset twist by applying enough force to the heatset yarn, this is not done in practice. The term "stress relaxation response" refers to the response to either latent stress relaxation or induced stress relaxation. A latent stress relaxation response is not evident unless initiated by sufficient energy (heat, mechanical, etc.) to permit molecular mobility to a more relaxed state. Induced stress relaxation response is a response to stress that is introduced, such as by drawing.

The present invention is a self-setting yarn that obviates heatsetting. This is accomplished by mechanically or thermally stressing a yarn composed of multicomponent fibers. Upon relaxation, the components return to different states of strain, causing the filament to form a helix about its longitudinal axis. The helixes of neighboring filaments intermingle, thus interlocking the individual filaments. When such fibers are made into tufted carpet, the integrity of the tufts is enhanced. Furthermore, it is believed that the top of such tufts resist flaring because of the intertwined fiber tips.

The yarn of this invention is made of bicomponent fibers or a blend of mostly bicomponent fibers with monocomponent fibers. Bicomponent fibers useful in the present invention may be eccentric sheath/core fibers or side-by-side fibers (or variations of these), but are preferably of the side-by-side type. In some cases, it may be advantageous to use an eccentric sheath/core configuration, such as where the processing conditions typically required to achieve satisfactory bulk are unsuitable for one of the components. For example, in the case of a nylon 6 core/polypropylene sheath, the high temperatures needed to generate bulk softens the polypropylene. In such cases, the additional bulk developed with the present invention obviates the unsuitably high temperature if an eccentric sheath/core fiber is used. It will be understood that the fibers used in the present invention could have more than two components, e.g., tricomponent fibers. For simplicity, the discussion of the invention uses "bicomponent" and those of ordinary skill in this art should be readily able to translate the principles of the invention into fibers having more than two components. The yarn may be made of filaments or staple. The yarns of this invention can be used in all carpet and textile end uses where their properties lend advantage.

The components of the bicomponent fiber useful in the present invention are polymers that have differing relative stress relaxation responses after application of mechanical or thermal stresses such that tuft integrity, i.e., tuft tip definition, is realized from helical crimping instead of heatsetting. (For the purposes of this invention, a "tuft" is a cut end of a yarn, whether or not the end of yarn is drawn through a fabric or in the form of a carpet.) The disparity in the stress relaxation response will depend on the end use, for example, the twist level to be used, the traffic conditions inherent in the end use, etc. To illustrate, the disparity between the components' stress relaxation response might be higher for commercial carpet end uses than for bath rug end uses. Thus, when considered relative to each other the polymers (and the cross-sectional components made thereof) can be referred to as the "high-recovery polymer (or component)" and the "low-recovery polymer (or component)". When such a fiber is subjected to stress the high-recovery component will return more to its original condition (i.e., length) than the low-recovery component will. Accordingly, if the fiber is stretched and then allowed to relax it will develop helical crimp.

FIGS. 2–6 show various fiber shapes that are useful in the yarn of the present invention. These shapes are presented as examples of shapes that are useful in the present invention. There is not believed to be any limit on the shapes that might be used. In FIGS. 2–6, two different domains, i.e., polymers having respectively different stress relaxation properties, are identified as A and B. The fibers shown in FIGS. 2–6 have an approximately 50:50 volume ratio of polymer A to polymer B. The two components in the fiber need not, however, be in a 50:50 volume ratio. Indeed, the ratio of the polymers can range from about 10:90 to about 90:10. The preferred ratio of polymers is from 70:30 to 30:70. If one of the polymers is very expensive, then it is advantageous to use this polymer in the lesser amount, i.e., 40% or less of the cross-section.

Figure 2:
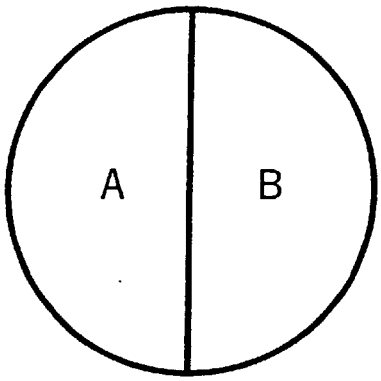
FIG. 2 shows a cross-section of a round fiber useful in the yarn of the present invention.

FIG. 2 shows a fiber with a round cross-section.

Figure 3:
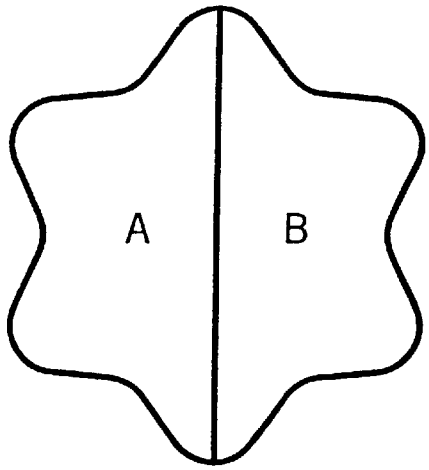
FIG. 3 shows a cross-section of a multilobal fiber useful in the yarn of the present invention.

FIG. 3 shows a multilobal (6-lobes are shown) fiber that might be used, for example, in yarns where it is desirable to reduce objectionable glitter under sunlight.

Figure 4:
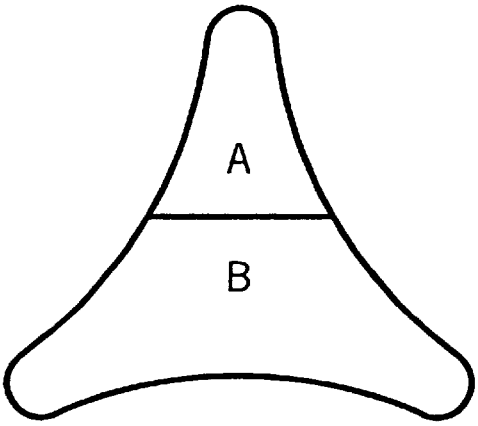
FIG. 4 shows a cross-section of a trilobal fiber useful in the yarn of the present invention.

FIG. 4 is a trilobal fiber of the type that is often used in carpet yarns.

Figure 5:
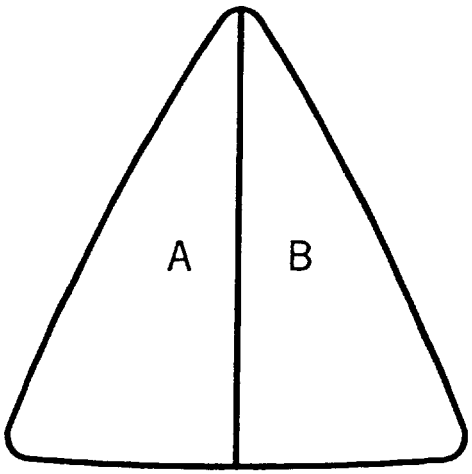
FIG. 5 shows a cross-section of a triangular fiber useful in the yarn of the present invention.
Figure 6:
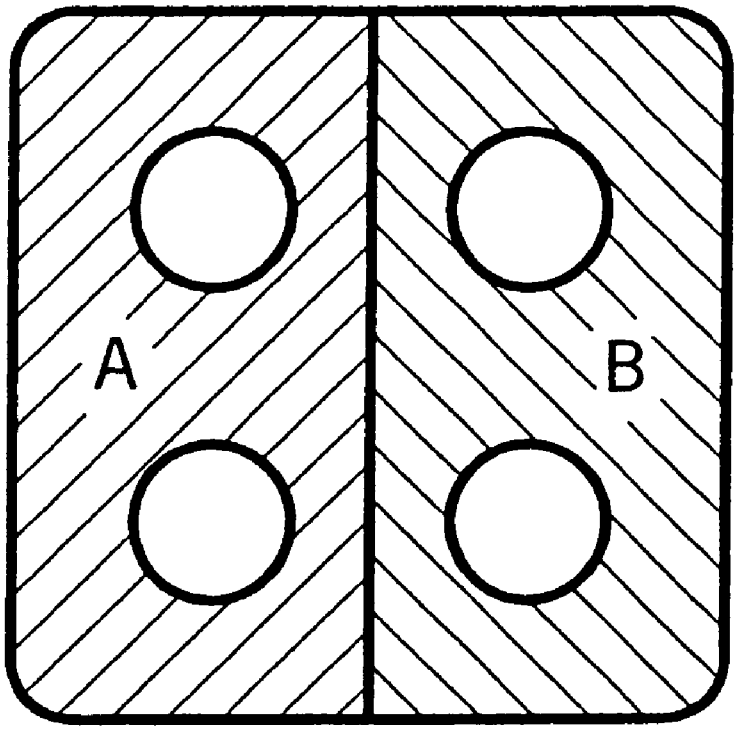
FIG. 6 shows a cross-section of a square fiber having four longitudinal voids that is useful in the yarn of the present invention.

FIG. 5 is a triangular fiber which might be used in applications where its luster effects are desirable.

Polymers suitable for use as polymer A or polymer B can be any fiber-forming polymers, preferably polymers that can be melt spun, that have the requisite relative difference in stress relaxation properties. Examples of suitable polymers are poly(ethylene terephthalate) ("PET"), modified poly (ethylene terephthalate) (e.g., poly(ethylene terephthalate modified with 20 mole percent isophthalic acid), poly (butylene terephthalate)("PBT"), copolyesters, polyarnides (such as nylon 6 ("N6"), nylon 6/6 ("N6,6"), nylon 6/12), modified polyarnides (e.g., polyarnides modified with cationically dyeable groups or ultraviolet light stabilizers), copolyarnides, polyethylene, polypropylene (such as isotactic polypropylene and syndiotactic polypropylene) ("PP"), and other spinnable polymers. Of course, the choice of the polymers depends upon the fiber properties for the intended end use, as well as stress relaxation characteristics. In choosing the polymers, it is currently preferred that the drawn bicomponent fiber is capable of at least a 10% change (decrease) in length following subsequent drawing or thermal treatments. A greater length decrease, about 25% is more preferred and most preferably the difference in stress relaxation response between the components will result in a length decrease of about 50%. The phenomenon of length change is described in more detail below. Exemplary combinations of polymers are: PET/PBT, high RV N6/low RV N6 (RV difference is relative), N6/PP, N6/N6,6, N6/PET, N6/PBT, etc.

Various additives may be added to the respective one or both polymers. These include, but are not limited to, lubricants, nucleating agents, antioxidants, ultraviolet light stabilizers, pigments, dyes, antistatic agent, soil resists, stain resists, antimicrobial agents, and flame retardants.

Although there is not believed to be any real limitation on the denier of the fibers used in the present invention, the denier used will be determined by the end use. In the case of carpet yarns usually a single end will include between about 40 and about 100 filaments, with each filament having a density of about 5 to about 30 denier, more preferably between about 10 and about 30 denier, and most preferably, at least 15 denier.

Fibers, such as those illustrated in FIGS. 2–6, may be made by delivering the polymers, A and B, to a spinneret in the desired volume ratio. While any conventional multicomponent spinning technique may be used, an exemplary spinning apparatus and method for making bicomponent fibers is described in U.S. Pat. No. 5,162,074, to Hills, which is incorporated herein by reference.

A bicomponent multifilament singles yarn can be produced by direct spinning into an undrawn yarn or a partially oriented yarn which is then, in a separate step, drawn, partially drawn or draw-textured. This process is sometimes referred to in the art as a "two-step" process. Alternatively, the same yarn can be produced by direct spinning from polymers into yarn via in-line spin-draw-texturing, sometimes referred to in the art as a "one-step" or "SDT" process. Furthermore, a staple yarn can be produced by spinning the polymers into filaments which are subsequently drawn, crimped, cut into staple lengths and spun into a spun yarn.

The yarn may be textured according to any conventional texturing process. For example, a pneumatic stuffer box principle may be use to make BCF yarns with irregular out-of-phase fold-type crimps in each filament. However, texturing is not an essential step and may be eliminated if the yarn exhibits sufficient added bulk and cover if the stress relaxation response disparity between the components is sufficiently great.

The yarn is then twisted before or after an initial draw. Any of the twisting processes known to those of ordinary skill in the art may be employed in the present invention. For example, each singles yarn may be twisted to produce a twisted singles yarn. Two or more singles may be twisted about each other without imparting twist in the singles such as in a cable-twisting process. Alternatively, two or more singles may be ring-twisted together to achieve a balanced twist wherein there is S or Z twist in each singles yarn and opposite twist in the cable. These examples should not be considered limiting of the invention. It is contemplated that a number of twisting processes could be used in the present invention. Each single end may be ply-twisted with another single end into, for example, a 2-ply twisted yarn, having (for example) 4 turns per inch. The ends may be direct cabled, in which case they have no twist in the singles, or they may be twisted in the singles and then plied. The yarn may be twisted to any conventional twist level, such as from about 1 to about 10 turns per inch ("tpi") (0.4 to 4 turns per cm ("tpc")), preferably, from about 1 to about 8 tpi (0.4 to 3 tpc), most preferably, from about 3 to about 6 tpi (1.2 to 2.4 tpc), all depending on the intended end use for the yarn. Additionally, it will be recognized that another benefit of the present invention is that more twist develops after the stress relaxation so the yarn could be twisted less than needed for the end use, with the additional twist developing as a result of helical crimp development.

As noted, the invention includes subjecting the filaments to mechanical or thermal stress, followed by relaxation, to develop the crimp in the yarn. A host of possibilities for the stressing step are contemplated and the following details should be considered as only exemplary of the process flexibility advantageously available with the invention. The mechanical stress may fall generally into one of two types: stretching following an initial draw (i.e., subsequent draw of previously drawn yarn); and stretching of undrawn yarn. In the first type of process, it is contemplated that the fibers can be initially draw and then, in a later step, perhaps following intervening steps (like twisting), stretched and relaxed to develop the latent crimp.

Alternatively, there might be no initial draw of the singles yarns which are twisted. Subsequently, the twisted yarn is subjected to a draw of perhaps 100% to 300% or more to develop the crimp, thereby developing bulk and twist-lock simultaneously. This process obviates the initial partial draw, saving labor and time.

It is also possible to develop the latent crimp with a thermal treatment, such as in a dye bath or steam box. Both drawn and undrawn yarns could be steamed subsequent to twisting to develop crimp. Likewise, subsequent dye processing may further develop crimp. Dye processes include bulk, skein or continuous dyeing. This alternative process step obviates the subsequent draw step. If sufficient bulk and cover are obtained by thermal activation, texturing could also be eliminated. In the case of an undrawn yarn, both the initial draw, texturing and subsequent draw would all be eliminated, reducing the manufacturing cost significantly. In general, thermal treatment activates only latent helical crimp, while mechanical treatment activates either latent and/or induced helical crimp.

As noted, singles yarns can be converted into a plied yarn via conventional twisting methods which are readily known to those who are of ordinary skill in this art. If already partially drawn, the plied yarn is stretched (mechanically stressed), preferably at ambient temperature, to from about 5% to about 50% more than its length. If it is undrawn, it may be drawn about 100% to about 400% to develop crimp. The stretching may be accomplished in a separate step or in twisting, in tufting, or as some other intermediate step. It may be possible to induce sufficient stress in the singles, during twisting, such that when the singles are combined, the twisted product develops helical crimp. In this case, the twisted product would not receive additional draw. It is also possible to fully develop available helical crimp in the singles prior to cable-twisting, provided tensions are sufficient to fully straighten singles prior to the twisting apex. Once together and relaxed, the singles return to their helically crimped state, locking twist into the cable-twisted product. In the case of cut-pile carpeting, the stretching step could be accomplished by modifying a cut pile tufting machine to include pretension rolls or other means to stretch the yarn to the desired degree. Alternatively, thermal stress could be substituted in lieu of the drawing steps described above to activate helical crimp. Thermal stress may be applied via dyeing or steaming of the yarn either before, or preferably after, twisting.

The duration and rate of mechanical activation as well as the temperature and duration of the thermal activation will vary according to the physical properties of the polymers used in the yarn. For some polymers, if the stretching force is applied for too long, the polymer molecules may begin to align, thus, diminishing the formation of latent crimp and, therefore, helixes. For some combinations, it may be necessary to spread the filaments prior to stretching to prevent contact of undrawn sections of filaments with drawn sections of other filaments. It is believed that such contact constrains the curling of the filaments upon stress relaxation.

After the application of stress, whether mechanical or thermal, the yarn is allowed to relax. As crimp develops in the yarn, the yarn reduces its length. To illustrate, a drawn yarn having an initial length of L1 is stretched to an intermediate length of L2, which is greater than L1. When relaxed, the yarn returns to some final length L3 where L3<L1<L2. L3 might be 10% (or more) less than L1. In the case of undrawn twisted yarn having a length of L1, stretched to some intermediate length L2 which is greater (perhaps by about 100% to about 300% (or maybe less) in the case of an undrawn yarn ) than L1. When relaxed, the yarn returns to some final length L3, where L1<L3<L2. L3 may be 10% (or more) less than L2. A thermal treatment, such as steaming subsequent to stretching may assist helical relaxation of the twisted yarn, developing additional twist-lock and bulk. As the bulky yarn decreases in length, it increases in twist level, since the same amount of twist that was inserted into one unit of length is now inserted in about 10% to about 50% less length. The resultant yarn has more bulk and twist (in turns per inch of tension free yarn length) than that of the same yarn before stretching. Although twist and bulk are gained, overall length of the twisted yarn is reduced.

The plied yarn has, unexpectedly, a very stable twist. If the yarn is cut, the cut ends preserve their twist integrity as well as or better than a conventional heatset plied yarn. Each singles yarn, after being separated from the plied yarn, has distinguishable ply-twists the same as (or even better than) those pulled out of conventional heatset plied yarn. The ply-twists are locked in place by helixes and fiber mingling existing along the singles yarn. If the singles yarn is pulled out of the same plied yarn prior to the cold stretching (or thermal stress), it has no ply-twists. In the case of a singles yarn that is twisted, but not plied, the twists are locked in place by the cold stretching or thermal stress.

Keeping the concept described above in mind, the yarn may be tufted or woven into carpets, used in textile applications where its unique effects provide value; and otherwise utilized in the usual fashion for yarns of the type. If desired, a simple steaming of the face of the final carpet can be used to develop maximum bulk in cut pile tufts or even rejuvenate worn carpet.

The invention will be described by referring to the following detailed Examples. These examples are set forth by way of illustration and are not intended to be limiting in scope. In the Examples, relative viscosity (RV) is reported as measured in 90% formic acid at 25° C.

SPINNING PROCESS

In many of the following Examples, side-by-side fibers are spun using two extruders to melt and feed two different polymers to a common spin pack comprised of thin plates, such as described in U.S. Pat. No. 5,162,074 to Hills. A Control is made using 2.7 RV N6 feed through both extruders to make a monocomponent fiber spun under bicomponent conditions. Channels on the thin plates divide the incoming streams corresponding to the number of filaments being spun. The respective polymers are then combined at each backhole of the spinneret to form the multicomponent fiber. An infinitely variable number of compositions are possible depending on the relative output of the spin pumps. The pack and the block housing are maintained at a temperature appropriate for the polymers being spun. For example, in a N6/PET combination the pack and housing could be maintained at about 295° C. As stated, the throughputs of the respective polymers vary according to the ratio of the polymers in the spun fiber, e.g., 50:50, 70:30, 80:20, etc. The temperature of the extruders' heating zones will be those temperatures appropriate for the type of polymer being extruded. For example, the extruder zone temperatures range from about 260° C. to about 270° C. for N6 and about 280° C. to about 295° C. for PET.

The fibers are quenched with air as they exit the spinneret. The quench air temperature and flow rate used is appropriate for the polymeric composition of the fibers. For example, air at about 21° C. flowing at 0.56 cm of $H_2O$. The quenched filaments might then be drawn, fully or partially, between a heated feedroll and a heated draw roll. This singles fiber may then be textured and interlaced to suit its final application.

TWISTING PROCESS

When the yarns are twisted, two or more of the singles fiber are twisted together 4.0 to 6.0 tpi (1.6 to 2.4 tpc) using a Volkmann VTS-05-C cable-twister at 2300–4500 rpm.

EXAMPLES 1–5

PREPARATION AND EVALUATION OF SELF-SETTING YARNS

EXAMPLES 1A–1E (N6/PET)

N6/PET side-by-side trilobal fibers are spun using N6 chip (2.7 RV or 3.5 RV) (BS700 or B35, respectively, both available from BASF Corporation, Mt. Olive, N.J.) and PET chip (MFI 18) (0.64 IV available from Wellman Inc.) The throughput varies to achieve the component ratios specified in Table 1. The heating zones in the extruders range from 260° C. to 270° C. for N6 and 280° C. to 295° C. for PET. The spin pump and block housing the spinneret are maintained at 295° C. In Examples 1A–1G and 1I–1K, the bicomponent fibers exiting the spinneret are quenched with 21° C. air at 0.56 cm $H_2O$. In Example 1H, the quench air is cut-off.

In Examples 1A–1J, the quenched fibers are drawn between a feed roll turning at 293 M/min and a draw roll maintained at 100° C. and 136° C., respectively, such that 50% or more elongation is retained in the drawn yarn. The drawn fiber is textured and interlaced. To assess crimp potential, each sample is drawn by hand. As described in more detail below, a subsequent draw produces a twisted product that does not need to be heatset prior to tufting.

In Example 1K, the quenched filaments are not drawn, textured or interlaced before stretching.

Crimp potential is assessed by drawing each sample by hand at ambient temperature.

TABLE 1

| Example | RV (N6) | N6:PET | Initial Draw Ratio | Crimp Potential |
|---|---|---|---|---|
| 1A | 2.7 | 50:50 | 3:1 | High |
| 1B | 2.7 | 70:30 | 3:1 | High |
| 1C | 2.7 | 80:20 | 3:1 | High |
| 1D | 2.7 | 90:10 | 3:1 | Moderate |
| 1E | 2.7 | 30:70 | 3:1 | High |
| 1F | 3.5 | 30:70 | 3:1 | High |
| 1G | 3.5 | 70:30 | 3:1 | High |
| 1H | 3.5 | 50:50 | 3:1 | High |
| 1I | 3.5 | 50:50 | 3:1 | High |
| 1J | 3.5 | 80:20 | 3:1 | High |
| 1K | 3.5 | 50:50 | None | High |

EXAMPLES 2A–2F

N6/N6

N6/N6 side-by-side trilobal fibers are made by spinning various combinations of N6 chip with 2.7 RV, 2.4 RV, and 3.5 RV (BS700, BS400, and B35, respectively, all available from BASF Corporation, Mt. Olive, N.J.). The N6 combinations are shown in Table 2. The spin pack is heated to 270° C. The heating zones in the extruders range from 260° C. to 270° C. The spin pump and the block housing the spinneret are maintained at 270° C. As they exit the spinneret, the fibers are quenched with 21° C. air at 0.76 cm of $H_2O$. Examples 2A–2E are bagged or wound samples as described in Table 2 that did not receive initial draw or texture prior to stretch. Example 2B is wound at 250 to 300 m/min. The filaments exhibit crimp when cold (ambient) drawn. In Example 2F, the filaments are drawn at a ratio of 3.2:1 at 133° C. and then wound.

In addition for Example 2G, a 10 denier per filament 50:50 bicomponent yarn of N6(3.5 RV)/N6(2.4 RV) is spun. The block and pack temperature is maintained at approximately 290° C. Quench air is maintained at 12° C. and 36.6 meters per minute. The yarn is drawn at a 1.1 draw ratio, 85° C., at 1870 meters per minute. The yarn is not textured. As pulled from the package, the yarn demonstrated crimp.

To assess crimp potential, each sample is drawn by hand at ambient temperature. Crimp potential for Example 2G is assessed by steaming it over 80° C. water for 10 seconds.

TABLE 2

| Example | RV of N6(1) | RV of N6(2) | N6(1):N6(2) | Sample Type | Initial Draw Ratio | Crimp Potential |
|---|---|---|---|---|---|---|
| 2A | 3.5 | 2.7 | 50:50 | Bag | None | Low |
| 2B | 2.7 | 2.4 | 50:50 | Wound | None | Low |
| 2C* | 2.7 | 2.4 | 50:50 | Bag | None | High |
| 2D | 3.5 | 2.4 | 25:75 | Bag | None | Low |
| 2E | 3.5 | 2.4 | 33:67 | Bag | None | Moderate |
| 2F | 2.7 | 2.4 | 50:50 | Wound | 3.2:1 | Low |
| 2G | 3.5 | 2.4 | 50:50 | Wound | 1.1:1 | High |

*same as 2B but L/D of spinneret changed

EXAMPLES 3A–3G

N6/PP

Side-by-side trilobal fibers are made by spinning N6 in 50:50 weight ratio with PP alloys. The spin pump and the spinneret are maintained at about 270° C. The heating zones in the extruders range from about 260° C. to about 270° C. for both polymers. As they exit the spinneret the fibers are quenched with 20° C. air at 1.5 cm of $H_2O$. The quenched filaments are drawn at 140° C., at draw ratios ranging from 2.4 to 3.0. Some samples are textured while others are not textured.

For Example 3H, an approximately 20 denier per filament N6(2.7 RV) and a PP Alloy is spun maintaining the block and pack temperatures at 270° C. The sample is drawn at a 3.1 draw ratio, 25° C., at 700 meters/min. Quench air is maintained at about 12° C. and set at 12.2 meters per minute. The sample is not textured. The final DPF was about 20.0.

To assess crimp potential, each sample is drawn by hand at ambient temperature. Crimp potential for Example 3H is assessed by steaming it over 80° C. water for 10 seconds.

TABLE 3

| Example | MPP in 1st Component (%)* | N6 in 2nd Component (%) | PP in 2nd Component (%) | MPP in 2nd Component (%) | 1st Component: 2nd Component | Initial Draw | Crimp Potential |
|---|---|---|---|---|---|---|---|
| 3A | 0 | 85* | 10 | 5 | 50:50 | | Low |
| 3B | 0 | 75* | 20 | 5 | 50:50 | | Low |
| 3C | 0 | 75** | 20 | 5 | 50:50 | | Low |
| 3D | 10 | 0 | 90 | 10 | 50:50 | | High |
| 3E | 15 | 0 | 90 | 10 | 50:50 | 3:1 | High |
| 3F | 15 | 0 | 90 | 10 | 50:50 | 2.8:1 | High |
| 3G | 0 | 85** | 10 | 5 | 50:50 | | Low |
| 3H | 0 | 15* | 70 | 15 | 50:50 | | High |

*RV = 2.7; alloy prepared by tumbling components
**RV = 2.7; alloy prepared by remelting components

EXAMPLES 4A–4B

PBT COMBINATIONS

Side-by-side trilobal fibers are made by spinning PBT in 50:50 weight ratio with PET or N6 (2.7 RV) as described in Table 4. In the case the PBT/PET combination, the spin pump and the block housing the spinneret are maintained at about 290° C. The heating zones in the extruders range from about 280° C. to about 295° C. for the PET and from about 250° C. to about 290° C. for the PBT. As they exit the spinneret the fibers are quenched with 20° C. air at 1.5 cm of $H_2O$. The quenched PBT/PET filaments are drawn at 136° C., textured and interlaced before winding.

In the case the PBT/N6 combination, the spin pump and the spinneret are maintained at about 270° C. The heating zones in the extruders range from about 252° C. to about 260° C. for the PBT and from about 259° C. to about 265° C. for the N6. As they exit the spinneret the fibers are quenched with 70° C. air. The quenched PBT/N6 filaments are drawn at 945 m/min, 145° C., textured and interlaced before winding.

Crimp potential is estimated by a hand drawing each sample.

TABLE 4

| Example | PBT: | :N6 | :PET | Initial Draw Ratio | Crimp Potential |
|---|---|---|---|---|---|
| 4A | 50 | 50 | — | 3.2:1 | Moderate |
| 4B | 50 | — | 50 | 3.2:1 | High |

EXAMPLES 5A–5I

N6/N6,6

Side-by-side trilobal fibers are made by spinning N6 in 50:50 weight ratio with N6,6. The spin pump and the block housing the spinneret are maintained at about 285° C. The heating zones in the extruders range from about 260° C. to about 270° C. for the N6 and from about 280° C. to about 295° C. for the N6,6. As they exit the spinneret the fibers are quenched with 20° C. air at 1.5 cm of $H_2O$. Some quenched filaments are drawn at 25° C., while others received zero draw.

None of the samples are textured.

In Examples 5H and 5I, filaments are cold-drawn.

To assess crimp potential, the samples are drawn by hand at ambient temperature.

TABLE 5

| Example | N6:N6,6 | Draw Ratio | Crimp Potential |
|---|---|---|---|
| 5A | 20:80 | 0 | Low |
| 5B | 40:60 | 0 | Moderate |
| 5C | 50:50 | 0 | Moderate |
| 5D | 60:40 | 0 | High |
| 5E | 80:20 | 0 | High |
| 5F | 50:50 | 0 | Moderate |
| 5G | 50:50 | 0 | High* |
| 5H | 50:50 | 2.0 | High |
| 5I | 50:50 | 3.0 | Moderate |

*on drawing

Some of the yarns made in the above Examples are tested using the procedures and methods described below.

TUFT INTEGRITY TESTING

Thermally Activated Samples.

A cabled-yarn section is cut approximately 1–1.5" long and threaded through a 380 micron thick black vinyl slide having a hole diameter of 1000 microns. The yarn is pulled, leaving 5 cm of the "tuft" exposed on the surface of the slide. The average tuft diameter at the tip is calculated from 3 diameters, each passing through a common intersecting point at the center of the tuft. Next, the affixed tuft is fully compressed 5 times to the surface of the slide with a flat, smooth, rubberized surface, large enough to cover the entire tuft. After compressions, the diameter measurements are repeated and the percent increase in tuft diameter is calculated.

This test quantifies tip degradation after five full compressions of a 5 cm long tuft. Tip diameters are measured for thermally treated and non-treated samples both before and after a series of 5 full compressions. Table 6 shows the change in tip diameter for samples that have not been thermally activated. Table 7 shows the change in tip diameter for samples that have been thermally activated. The larger the increase in tip diameter the more flaring and loss of tip definition in the sample.

The control is heatset using an autoclave. Heatset conditions include a 1 minute pre-vacuum, followed by two- 3 minute cycles at 110° C., followed by two-3 minute cycles at 270° C., followed by one- 6 minute cycle at 270° C., followed by one-1 minute cycle of post vacuum.

To thermally activate the samples, a cabled yarn section is allowed to relax for 5 minutes and then submerged in 80° C. water for 5 seconds, removed and allowed to dry. The non-heatset control is also given this thermal treatment.

TABLE 6

Before Thermal Activation of Helical Crimp

| Example | Description | BEFORE COMPRESSION DIAMETER (microns) | AFTER COMPRESSION DIAMETER (microns) | PERCENT INCREASE |
|---|---|---|---|---|
| Control | BS700/BS 700 (NON-HEATSET) | 1593.3 | 2742.1 | 72.1 |
| 4B | PET/PBT | 2356.9 | 3147.6 | 33.6 |
| 3F | N6 (2.7)/PP Alloy | 1794.4 | 6370.4 | 255.0 |

TABLE 7

After Thermal Activation of Helical Crimp

| Example | Description | BEFORE COMPRESSION DIAMETER | AFTER COMPRESSION DIAMETER | PERCENT INCREASE |
|---|---|---|---|---|
| Control | N6 (2.7 RV)/ N6 (2.7 RV) (HEATSET)* | 1253.4 | 1852.1 | 47.8 |
| Control | N6 (2.7 RV)/ N6 (2.7 RV) (NON-HEATSET) | 1361.5 | 1818.2 | 33.5 |
| 4B | PET/PBT | 2389.1 | 4312.9 | 80.5 |
| 3F | N6 (2.7)/PP Alloy | 2876.5 | 3159.7 | 9.8 |

Draw-Activated Samples

The tuft integrity test described above is used on cabled yarns whose helical crimp is activated by elongation in an Instron tensile testing apparatus, as well as samples that have not been activated. A non-heatset control is also drawn to 30% elongation.

The samples are draw-activated using an Instron tensile tester. A section of the yarn is clamped in an Instron tensile tester and elongated 30%. The results are presented in Tables 8 and 9.

TUFT LOCK ANALYSIS

A razor blade is used to cut 4 sections of yarn from each sample. Two of these pieces were placed on carbon (conductive) tape on a specimen holder so that the side of the cut could be observed. The other 2 pieces were sandwiched between carbon tape and placed in a clamping specimen holder (with about ¼ inch of the yarn protruding above the tape) so that the end of the yarn could be observed from the top. All specimens are sputter-coated with platinum to make them conductive for scanning electron microscopy ("SEM")

TABLE 8

Tuft Integrity Before Draw Activation of Helical Crimp

| Example | Description | BEFORE COMPRESSION DIAMETER | AFTER COMPRESSION DIAMETER | PERCENT INCREASE |
|---|---|---|---|---|
| Control | N6 (2.7 RV)/ N6 (2.7 RV) (NON-HEATSET) | 1593.3 | 2742.1 | 72.1 |
| 4B | PBT/PET | 2356.9 | 3147.6 | 33.6 |
| 1I | N6 (3.5 RV)/PET | 2322.2 | 3830.3 | 64.9 |
| 1A | N6 (2.7 RV)/PET | 1645.5 | 2769.7 | 68.3 |

TABLE 9

Tuft Integrity After Draw Activation of Helical Crimp

| Example | Description | BEFORE COMPRESSION DIAMETER | AFTER COMPRESSION DIAMETER | PERCENT INCREASE |
|---|---|---|---|---|
| Control | N6 (2.7 RV)/ N6 (2.7 RV) (HEATSET)* | 1253.4 | 1852.1 | 47.8 |
| Control | N6 (2.7 RV)/ N6 (2.7 RV) (NON-HEATSET) | 1183.2 | 2483.6 | 109.9 |
| 4B | PET/PBT | 2586.3 | 3251.4 | 25.7 |
| 1I | N6 (3.5 RV)/PET | 2920.2 | 3422.9 | 17.2 |
| 1A | N6 (2.7 RV)/PET | 2869.7 | 3397.1 | 18.4 |

analysis. The SEM photographs are presented in FIGS. 8A–8J. All photos shown are at 30× magnification.

The SEM procedure shows interlocking helixes on the tuft tip which contribute to maintaining tuft integrity. Filament entanglement is evident in the SEM illustrations of the N6(2.7 RV)/PP alloy after thermal activation (FIGS. 8C and 8E). This sample is also shown before thermal activation in FIGS. 8D and 8F for comparison purposes. Filament entanglement is also seen in after thermal activation in N6(2.7 RV)/PET (FIG. 8I); N6(3.5 RV)/PET (FIG. 8H); and PBT/PET (FIG. 8G). This entanglement is clearly not present in the respective control samples either before or after heatsetting.

Figure 8:
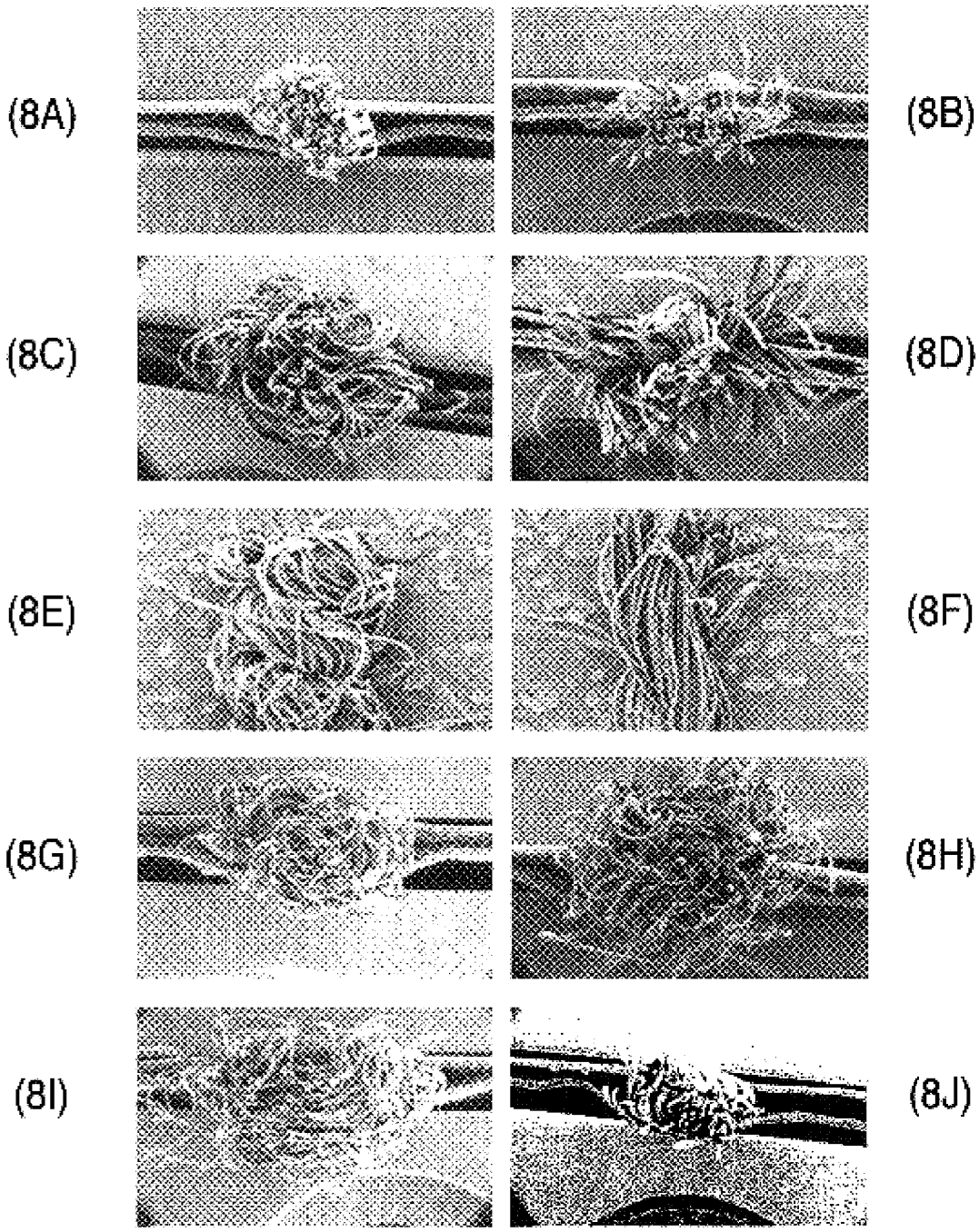
FIGS. 8A–8J are scanning electron micrographs illustrating tuft lock properties of yarns of a control sample (FIGS. 8A and 8B) as well as yarns of the present invention (FIGS. 8C–8J).

The impact of helical crimp development on cover is also illustrated in the SEM photographs of FIG. 8. The control (FIG. 8A) is much more lean (closely packed filaments), whereas the tufts of the present invention (FIGS. 8C, 8E and 8G–8I) after heatsetting are fuller. The additional cover is a result of helical bulk development as well as increased denier due to shrinkage of the cabled yarn. (Each sample is about 1200 denier having 70 filaments except for the control which has 72 filaments.)

STRESS RESPONSE FACTOR

A stress response test quantifies relaxation of both cabled-twisted and singles yarns subjected to both mechanical draw and thermal treatment. The amount of relaxation (change in length), in most cases, is an indication of the degree of helical crimp development resulting from mechanical or thermal treatments.

Thermal Relaxation for Cabled Yarns

After being cut, a cabled yarn section is allowed to relax for 5 minutes. It is then cut to 10 inches, submerged in 80° C. water for 5 seconds, removed and allowed to dry. Next, the length is measured and percent shrinkage recorded. Each sample is placed against a black velvet background and photographed. Photographs are made before and after thermal treatment. Each sample, before and after thermal treatment, is also untwisted. Permanent crimp in the singles, resulting from the cabled construction, is recorded in crimps per inch. The results are presented in Table 10.

TABLE 10

Relaxation Factor for Cabled Yarns

| Example | DESCRIPTION | INITIAL LENGTH | FINAL LENGTH | PERCENT CHANGE | SINGLES CABLED CRIMP BEFORE/AFTER THERMAL ACTIVATION | SINGLES CABLED CRIMP CRIMP SET BY THERMAL ACTIVATION |
|---|---|---|---|---|---|---|
| Control | N6 (2.7 RV)/ N6 (2.7 RV) | 10 | 9.75 | 2.5 | 0/0 | 0 |
| 4B | PET/PBT | 10 | 8.75 | 12.5 | 0/6 | 6 |
| 3F | BS 700/PP ALLOY | 10 | 5.1 | 48.3 | 0/7 | 7 |

Thermal Relaxation of Singles Yarn

After cutting a yarn section is allowed to relax for 30 minutes. The samples are then cut to 10 inches (25.4 cm), submerged in 80° C. water for 5 seconds, removed and allowed to dry. Next, the length is measured and percent shrinkage recorded. Helical crimp is counted on representative filaments selected from the sample. The denier of Individual filaments is determined with a Vibromat apparatus. The results are presented in Table 11. The above procedure is repeated on samples that are steamed (instead of submerged) over the 80° C. bath for 10 seconds. The results are presented in Table 12.

Figure 9:
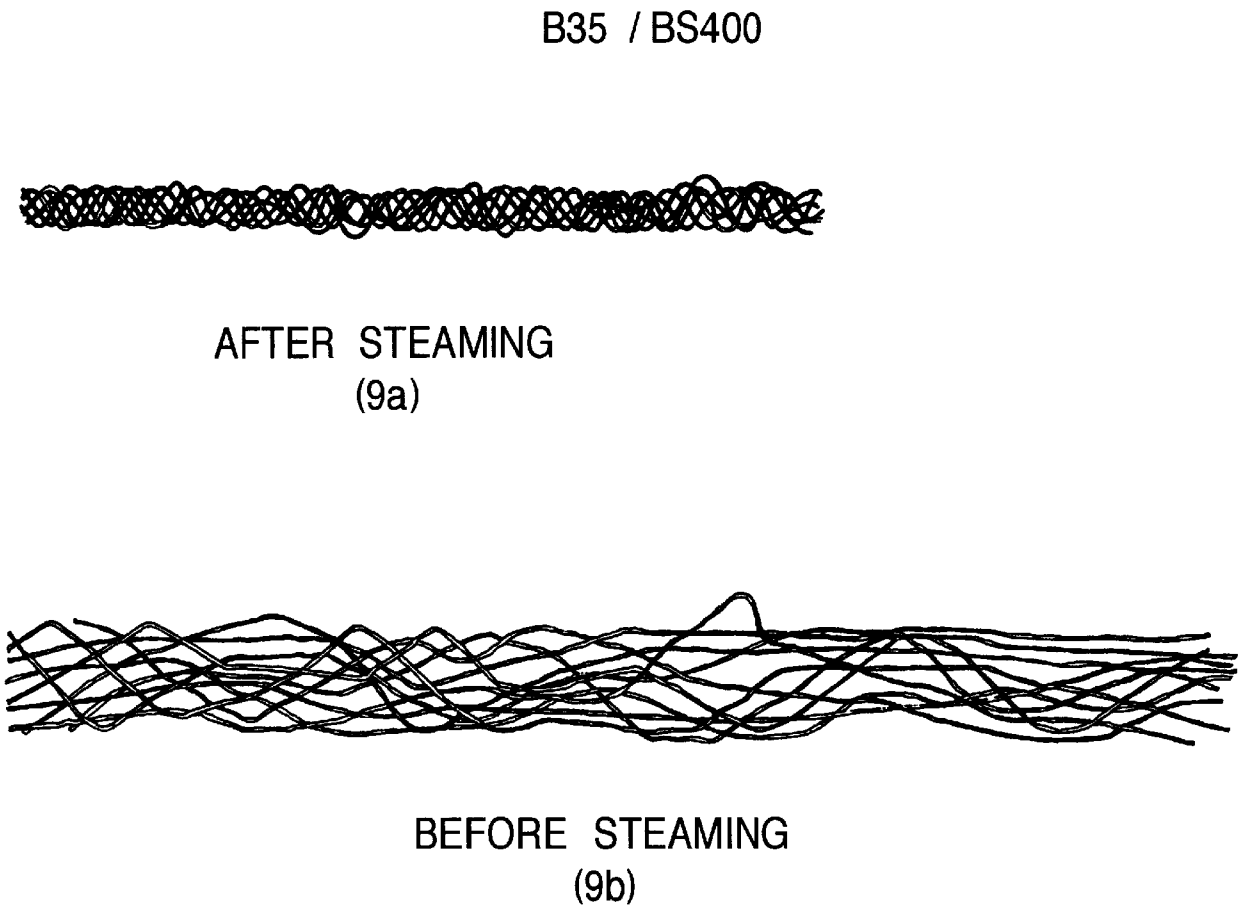
FIG. 9 is a photograph illustrating helical crimp development in a yarn of the present invention.

A 75 mm, black and white multipurpose land camera, is used to make black and white photos of 50:50 N6(3.5 RV)/N6(2.4 RV) after steaming and before steaming. FIG. 9 is the photograph of the Example 2G before and after steaming. The sample has moderate helical crimp as pulled from package before steaming. Helical crimp developed significantly when steamed, relaxing (shrinking) approximately 65%.

TABLE 11

Relaxation Factor for Singles (submerged samples)

| EXAMPLE | DESCRIPTION | INITIAL LENGTH | FINAL LENGTH | PERCENT CHANGE | FILAMENT CRIMP BEFORE/AFTER TREATMENT | HELICAL CRIMP DEVELOPED (PER INCH) |
|---|---|---|---|---|---|---|
| Control | N6 (2.7 RV)/ N6 (2.7 RV) | 10 | 8.83 | 11.7 | 3/4 | 1 |

TABLE 11-continued

Relaxation Factor for Singles (submerged samples)

| EXAMPLE | DESCRIPTION | INITIAL LENGTH | FINAL LENGTH | PERCENT CHANGE | FILAMENT CRIMP BEFORE/AFTER TREATMENT | HELICAL CRIMP DEVELOPED (PER INCH) |
|---|---|---|---|---|---|---|
| 4B | PET/PBT | 10 | 6.9 | 30.8 | 4/8 | 4 |
| 3F | BS 7001 PP ALLOY | 10 | 4.25 | 57.5 | 1/10 | 9 |
| 3H | N6 (2.7 RV)/ PP ALLOY w/N6 (2.7 RV) | 10 | 4.75 | 52.5 | 1/5 | 4 |
| 2G | N6 (3.5 RV)/ N6 (2.4 RV) | 10 | 7.5 | 24.2 | 3/11 | 8 |

The control and 4B are textured.
Examples 3F, 3H and 2G are not textured.

TABLE 12

Relaxation Factor for Singles (Steamed)

| EXAMPLE | DESCRIPTION | INITIAL LENGTH | FINAL LENGTH | PERCENT CHANGE | NOTATIONS |
|---|---|---|---|---|---|
| Control | N6 (2.7 RV)/ N6 (2.7 RV) | 10 | 8.25 | 17.5 | NORMAL BULK |
| 4B | PET/PBT | 10 | 7.25 | 27.7 | NORMAL BULK & HELICAL BULK |
| 3F | N6 (2.7)/ PP ALLOY | 10 | 3.12 | 68.7 | ALL HELICAL BULK |
| 3H | N6 (2.7 RV)/ PP ALLOY w/N6 (2.7 RV) | 10 | 3.75 | 62.5 | ALL HELICAL BULK |
| 2G | N6 (3.5 RV)/ N6 (2.4 RV) | 10 | 3.50 | 65.0 | ALL HELICAL BULK |

The control and 4B are textured.
Examples 3F, 3H and 2G are not textured.

Mechanical Stress Relaxation for Cabled and for Singles Yarns

A 10 inch section is marked on the yarn sample. The sample is clamped in an instron Tensile tester and elongated 10%. The sample is removed and the section is measured again. A percent shrinkage is calculated from section lengths before and after elongation. This procedure is repeated for elongations of 20, 30, 40 and 50%. After elongation, the sections are placed on a black velvet background and photographed.

Figure 10:
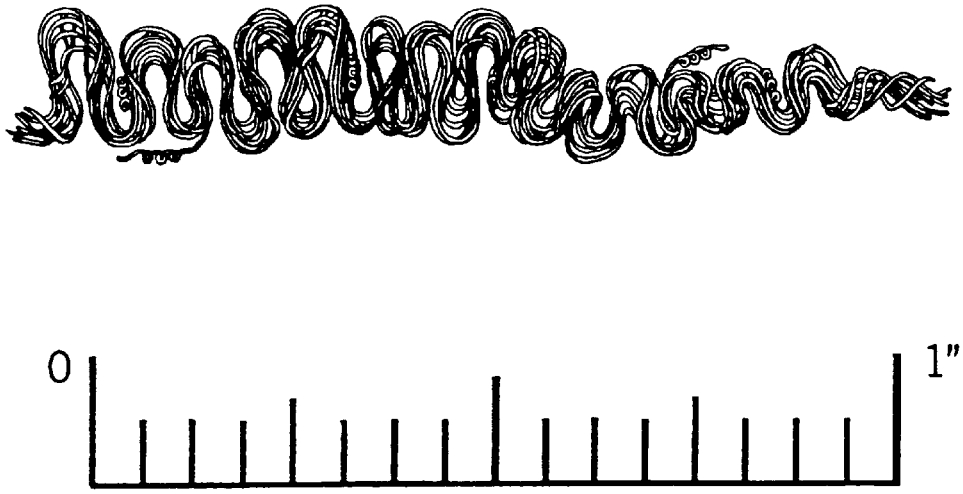
FIG. 10 is a photograph illustrating twist lock due to helical crimp in a yarn of the present invention.
Figure 11:
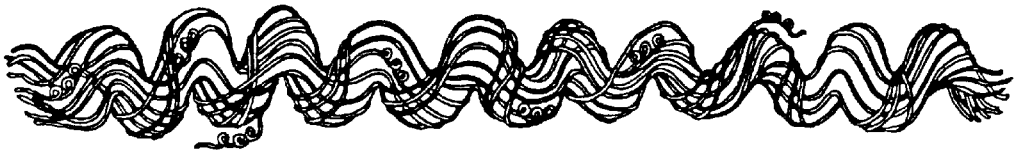
FIG. 11 is a photograph illustrating twist lock due to helical crimp in a yarn of the present invention.
Figure 11:
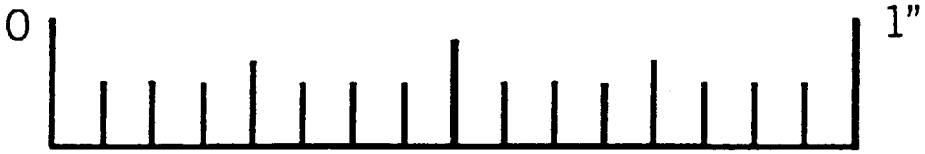
Figure 12:
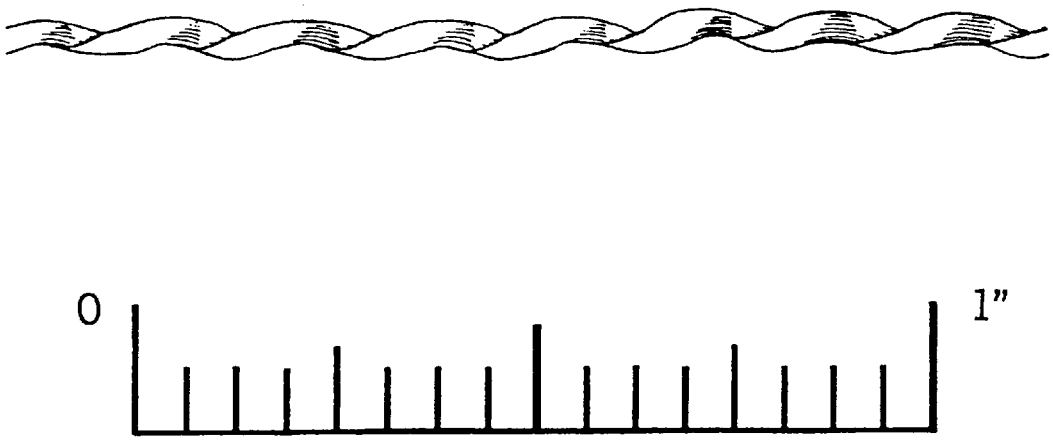
FIG. 12 is a photograph of a monocomponent nylon 6 control sample.
Figure 13:
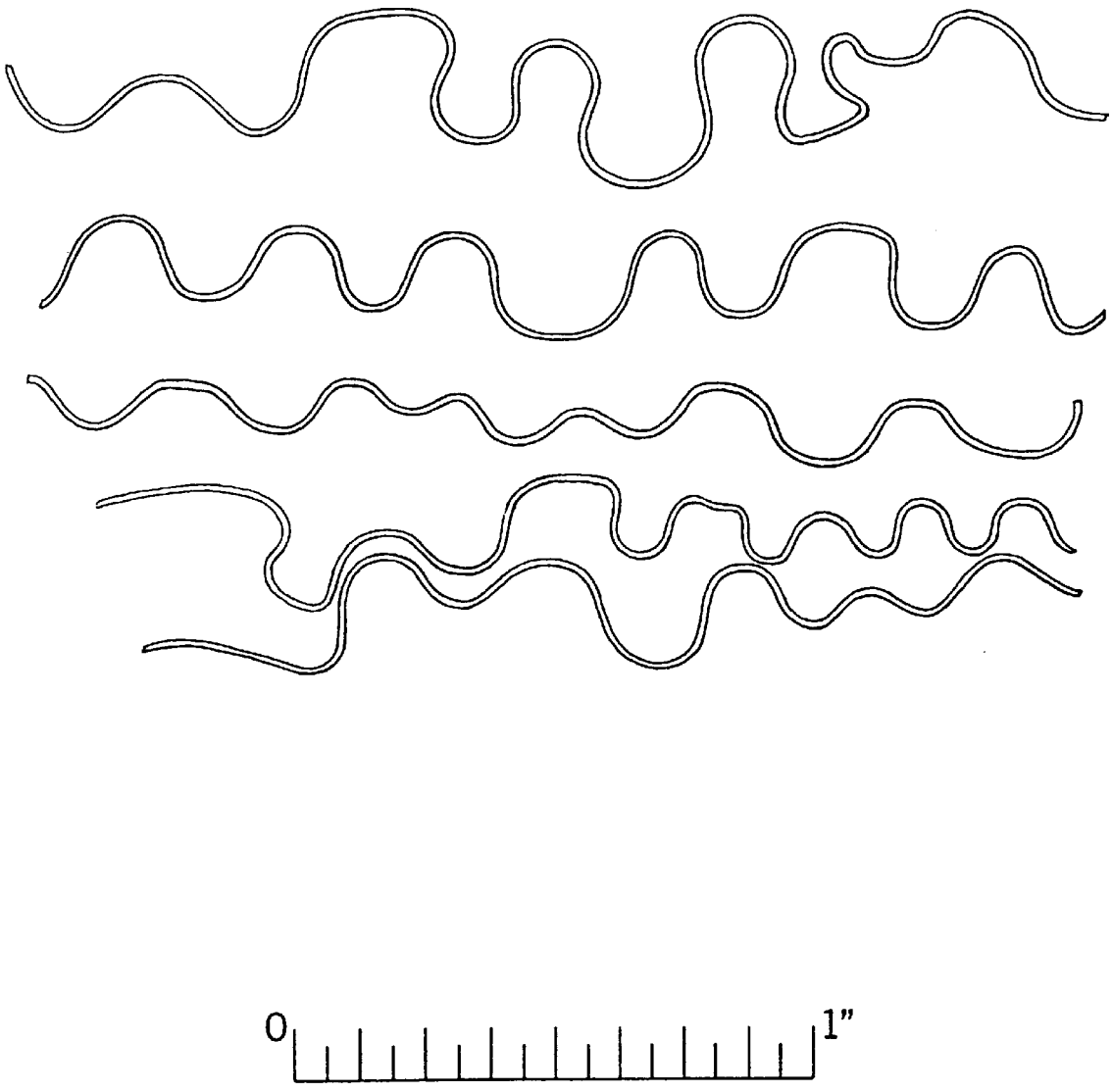
FIG. 13 is a photograph of showing helical crimps in filaments useful in the present invention.
Figure 14:
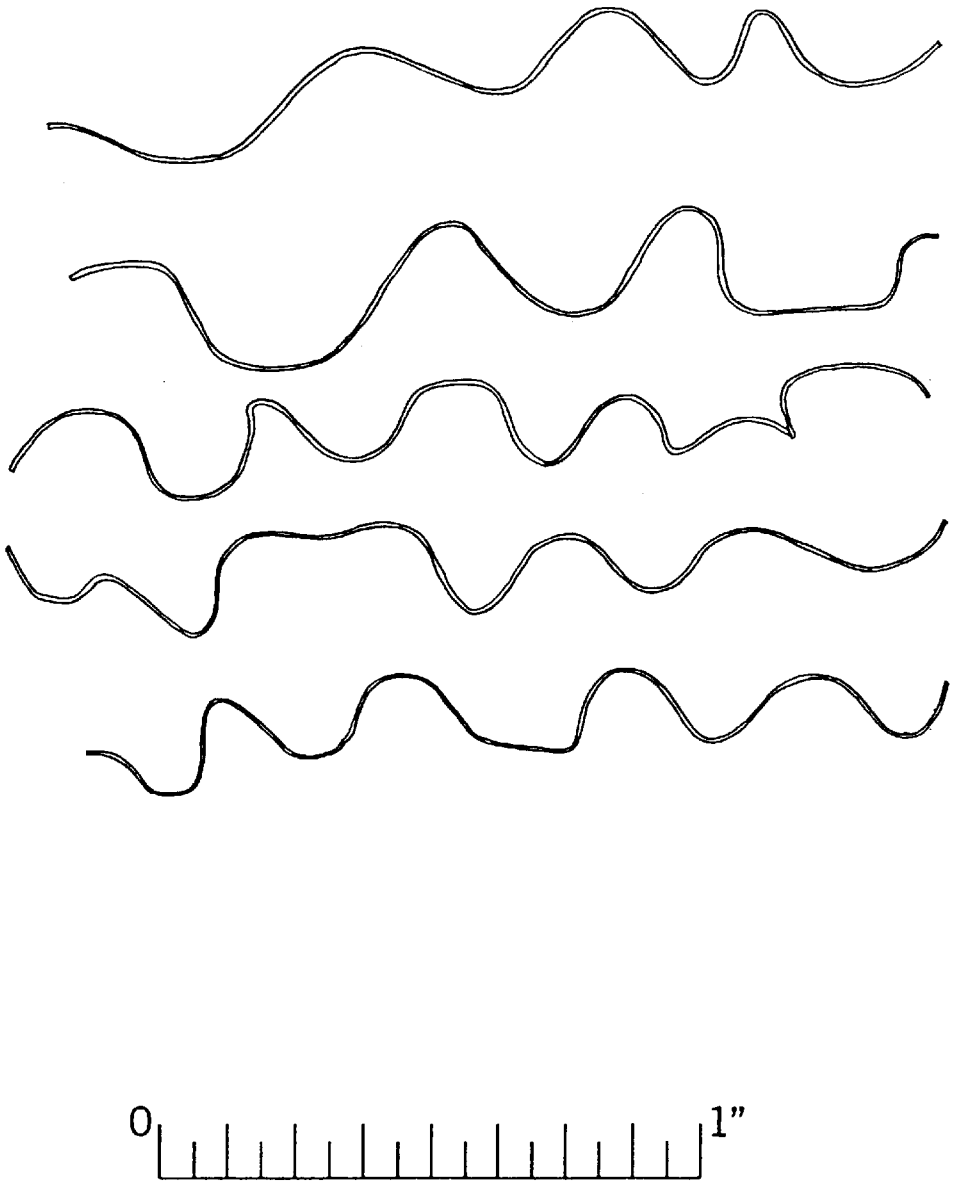
FIG. 14 is a photograph of showing helical crimps in filaments useful in the present invention.
Figure 15:
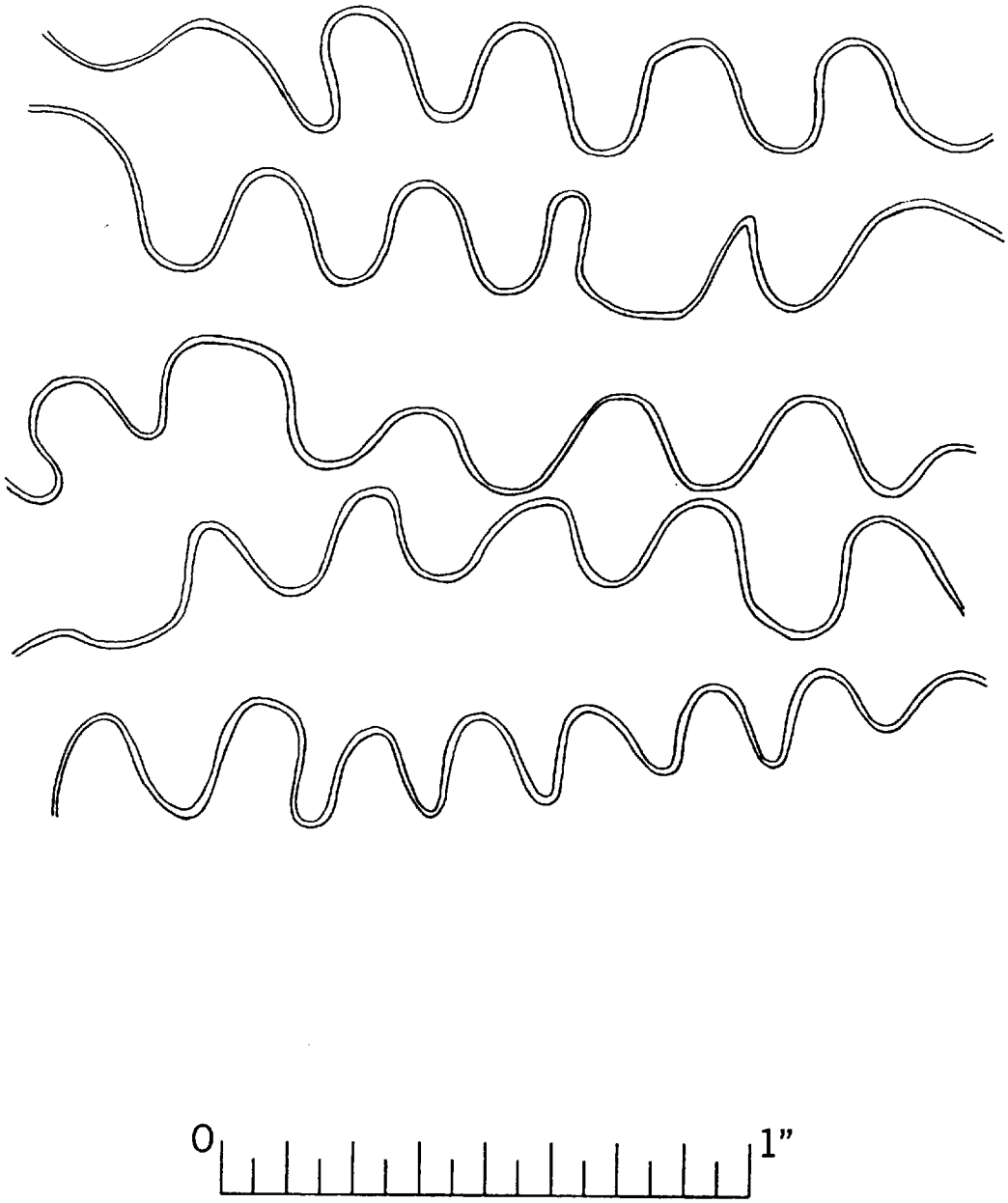
FIG. 15 is a photograph of showing helical crimps in filaments useful in the present invention.
Figure 16:
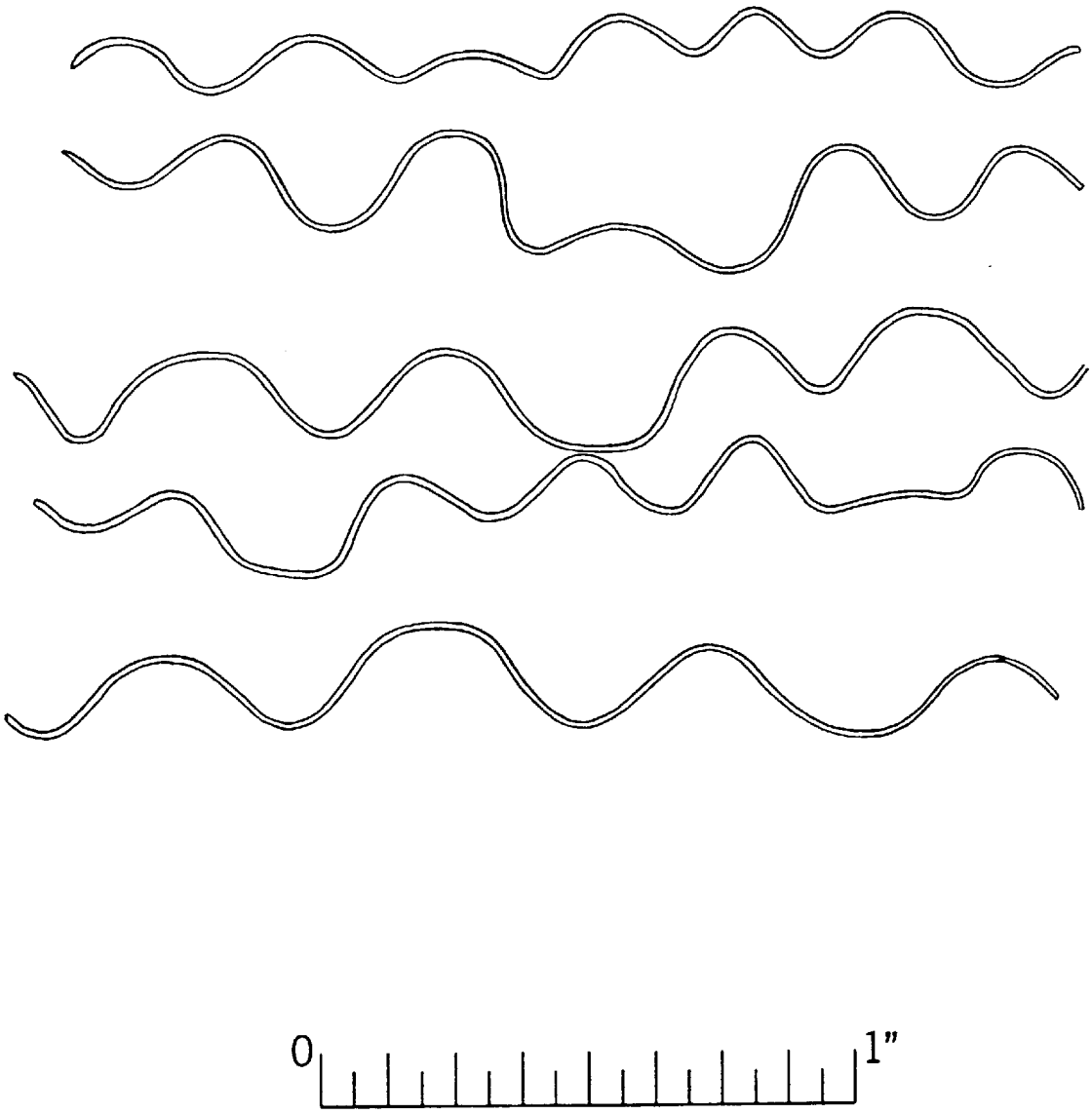
FIG. 16 is a photograph of showing helical crimps in filaments useful in the present invention.

For cabled yarn samples, the shortest sample is untwisted. The permanent crimps resulting from the cabled construction are counted. The untwisted section is then placed on a black velvet background and photographed. Using a 75 mm, black and white multipurpose land camera photographs of untwisted singles from Examples 4B, 1I and the control are made. These photographs are presented in FIGS. 10, 11 and 12, respectively. The magnitude of twist lock due to helical activation according to the present invention versus heatsetting is demonstrated in these FIGS.

The results of the testing of cabled yarn are presented in Table 13. The results of testing of singles yarn are presented in Table 14.

TABLE 13

Relaxation of Drawn Cabled Yarns

| EXAMPLE | ID | TPI | RATIO | INITIAL LENGTH (INCHES) | LENGTH AFTER 10% ELONG | LENGTH AFTER 20 ELONG | LENGTH AFTER 30% ELONG | LENGTH AFTER 40% ELONG | LENGTH AFTER 50% ELONG | CABLED CRIMPS SET IN SINGLE |
|---|---|---|---|---|---|---|---|---|---|---|
| 4B | PBT/PET | 6.0 | 50/50 | 10 | 8.4 | 5.9 | 5.25 | 7.3 | 11.25 | 11 |
| 1G | N6 (3.5 RV)/ PET | 6.0 | 70/30 | 10 | 9.6 | 8.5 | 8 | 8.25 | 8.9 | 7 |
| 1I | N6 (3.5 RV)/ PET | 6.0 | 50/50 | 10 | 9.4 | 7.25 | 7.25 | 7.3 | 7.4 | 8 |
| 1F | N6 (3.5 RV)/ PET | 6.0 | 30/70 | 10 | 9.5 | 7.7 | 7 | 7 | 7.8 | |
| 1B | N6 (2.7 RV)/ PET | 6.0 | 70/30 | 10 | 9.6 | 8.0 | 6.9 | 6.7 | 6.3 | 9 |

TABLE 13-continued

| EXAMPLE | ID | TPI | RATIO | INITIAL LENGTH (INCHES) | LENGTH AFTER 10% ELONG | LENGTH AFTER 20 ELONG | LENGTH AFTER 30% ELONG | LENGTH AFTER 40% ELONG | LENGTH AFTER 50% ELONG | CABLED CRIMPS SET IN SINGLE |
|---|---|---|---|---|---|---|---|---|---|---|
| | | | | Relaxation of Drawn Cabled Yarns | | | | | | |
| 1A | N6 (2.7 RV)/ PET | 6.0 | 50/50 | 10 | 9.7 | 1.5 | 6.6 | 6.9 | 7.25 | 9 |
| 1E | N6 (2.7 RV)/ PET | 6.0 | 30/70 | 10 | 9.75 | 7.75 | 7.25 | 7 | 7.25 | 10 |
| 3F | N6 (2.7 RV)/ PP ALLOY | 4.0 | 50/50 | 10 | 9.75 | 9.5 | 10.6 | 11.5 | BROKE | 5 |
| Control | N6 (2.7 RV)/ N6 (2.7 RV) | 6.0 | 50/50 | 10 | 9.9 | 10.4 | 10.5 | 10.9 | 11.7 | 6 |
| Control | N6 (2.7 RV)/ N6 (2.7 RV) | 4.0 | 50/50 | 10 | 9.75 | 10 | 10.75 | 10.9 | 11.5 | 4 |

TABLE 14

| EXAMPLE | ID | TPI | RATIO | INITIAL LENGTH (INCHES) | AFTER 10% ELONG | AFTER 20% ELONG | AFTER 30% ELONG | AFTER 40% ELONG | AFTER 50% ELONG |
|---|---|---|---|---|---|---|---|---|---|
| | | | | Relaxation of Drawn Singles Yarn | | | | | |
| 4B | PBT/PET | NA | 50/50 | 10 | 4.7 | 3.4 | 3.1 | 3.3 | 3.7 |
| 1G | N6 (3.5 RV)/ PET | NA | 70/30 | 10 | 5.9 | 3.75 | 3.2 | 3.4 | 3.75 |
| 1I | N6 (3.5 RV)/ PET | NA | 50/50 | 10 | 6.5 | 3.2 | 3.2 | 3.25 | 3.6 |
| 1F | N6 (3.5 RV)/ PET | NA | 30/70 | 10 | 7.9 | 4.8 | 3.7 | 3.9 | 4.1 |
| 1B | N6 (2.7 RV)/ PET | NA | 70/30 | 10 | 7.8 | 4.25 | 3.9 | 3.4 | 3.75 |
| 1A | N6 (2.7 RV)/ PET | NA | 50/50 | 10 | 6.9 | 4.4 | 3.4 | 3.8 | 3.8 |
| 1E | N6 (2.7 RV)/ PET | NA | 30/70 | 10 | 6.9 | 4.4 | 3.5 | 3.4 | 4 |
| 3F | N6 (2.7 RV)/ PP ALLOY | NA | 50/50 | 10 | 3.85 | 3.6 | 4.9 | 6.6 | 7.6 |
| Control | N6 (2.7 RV)/ N6 (2.7 RV) | NA | 50/50 | 10 | 6.9 | 9.3 | 10.7 | 11.5 | 12.25 |

HELICAL CRIMP DEVELOPMENT

Photographs are taken of untextured, flat samples from Examples 2G, 2B, 2C, and 5F to illustrate the helical crimp development activated by drawing. These samples are shown in FIGS. 13–16, respectively.

Five filaments are separated from each threadline and drawn by hand if not already drawn. Denier per filament is recorded before and after drawing to determine the draw ratio for hand drawn samples. The Vibromat apparatus is used to determine deniers.

A 75 mm, black and white Iand camera is used to make the black and white photos of cabled crimp and helical crimp of both single filaments and filament bundles, also referred to as singles.

Table 15 details the properties of the samples shown in the FIGS.

TABLE 15

| Example | ID | Hand Draw Ratio | Denier per Filament | Crimps per Inch |
|---|---|---|---|---|
| 2G (FIG. 13) | N6 (3.5 RV)/ N6 (2.4 RV) | 2.8:1 | 9.8 | 7 |

TABLE 15-continued

| Example | ID | Hand Draw Ratio | Denier per Filament | Crimps per Inch |
|---|---|---|---|---|
| 2B (FIG. 14) | N6 (2.7 RV)/ N6 (2.4 RV) | 3.8:1 | 12.1 | 4 |
| 2C (FIG. 15) | N6 (2.7 RV)/ N6 (2.4 RV) | 3.4:1 | 54.5 | 5 |
| 5F (FIG. 16) | N6 (2.7 RV)/ N6,6 (2.4 RV) | 4:1 | 21 | 3 |

COMPARATIVE EXAMPLE

FIGS. 1(*a*)–(*d*) illustrate a conventional 2-ply N6,6 yarn made from trilobal filaments. Two ends of the yarn are plied to make the 2-ply yarn shown in FIG. 1(*d*). FIG. 1(*c*) shows a single ply of the yarn, which is untwisted from non-heatset 2-ply yarn of FIG. 1(*d*). As shown, there is no residual ply-twist in the singles yarn of FIG. 1(*c*). The plied yarn is heatset at 270° C. using a Superba heatsetting apparatus to make the 2-ply yarn of FIG. 1(*b*). FIG. 1(*a*) is a singles yarn obtained from untwisting a single ply of the 2-ply yarn of FIG. 1(*b*). FIG. 1(*a*) illustrates the permanent ply-twists in the heatset ply.

INVENTION EXAMPLE 6

Figure 7:
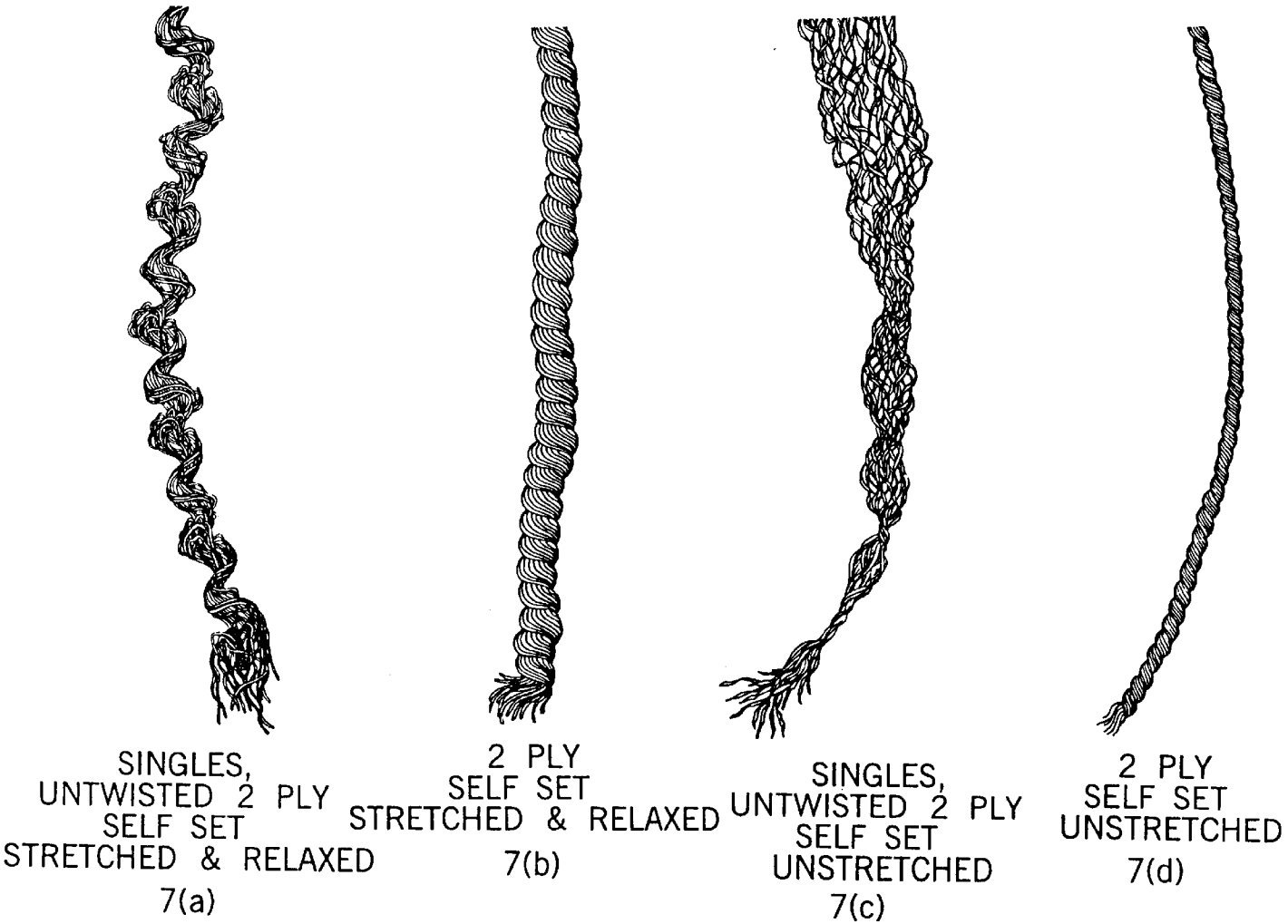
FIGS. 7(*a*)–(*b*) show a self-set yarn of the present invention.

FIGS. 7(*a*)–(*d*) illustrate a carpet yarn made of a self-set, trilobal cross section filament yarn of this invention. The side-by-side 50:50 PET/PBT bicomponent yarn is using a one-step bulked continuous filament process.

FIG. 7(*d*) is a 2-ply yarn prior to the stretching step. FIG. 7(*c*) is a singles yarn obtained from untwisting the 2-ply yarn of FIG. 7(*d*). As shown, there is no significant residual ply-twist in the singles yarn of FIG. 7(*c*).

The 2-ply yarn is then stretched by hand and relaxed. FIG. 7(*b*) shows the 2-ply yarn of FIG. 7(*d*) after being stretched and relaxed. FIG. 7(*a*) shows a singles yarn obtained from untwisting a single ply from the 2-ply yarn of FIG. 7(*b*). As shown, the singles yarn of FIG. 7(*a*) has permanent ply-twists.

What is claimed is:

1. A process for making a self-set yarn comprising:

(a) twisting a yarn comprised of a majority of multicomponent fibers having a first polymer component with a first stress relaxation response and, longitudinally co-extensive therewith, a second polymer component of a second stress relaxation response, wherein said first stress relaxation response and said second stress relaxation response are sufficiently different to produce at least a 10% decrease in length of said yarn and wherein the first polymer component and the second polymer component are arranged in a side-by-side or eccentric sheath/core fashion;

(b) after said twisting, stressing the resulting twisted yarn; and (c) after said stressing, allowing the twisted yarn to relax.

2. The process of claim 1 wherein said yarn is twisted to at least 1 tpi.

3. The process of claim 1 further wherein said twisting is ply-twisting together at least two plies of said multifilament yarn.

4. The process of claim 1 wherein said first polymer component is selected from the group consisting of:

poly(ethylene terephthalate);
modified poly(ethylene terephthalate);
poly(butylene terephthalate);
copolyesters;
nylon 6;
nylon 6/6;
nylon 6/12;
modified polyarnides;
copolyarnides;
polyethylene; and
polypropylene.

5. The process of claim 4 wherein said second polymer component is selected from the group consisting of:

poly(ethylene terephthalate);
modified poly(ethylene terephthalate);
poly(butylene terephthalate);
copolyesters;
nylon 6;
nylon 6/6;
nylon 6/12;
modified polyarnides;
copolyarnides;
polyethylene; and
polypropylene.

6. The process of claim 1 wherein said stressing is by stretching the yarn at ambient temperature to at least 10% of its original length.

7. The process of claim 1 wherein said stressing is by application of heat.

* * * * *